US005391444A

United States Patent [19]

Cuppen

[11] Patent Number: 5,391,444

[45] Date of Patent: Feb. 21, 1995

[54] METHOD OF FORMING A PATTERN ON A SUBTRATE, METHOD OF MANUFACTURING A DISPLAY DEVICE, DISPLAY DEVICE

[75] Inventor: Sebastianus N. G. Cuppen, Eindhoven, Netherlands

[73] Assignee: U.S. Philips Corporation, New York, N.Y.

[21] Appl. No.: 709,684

[22] Filed: Jun. 3, 1991

[30] Foreign Application Priority Data

Jul. 5, 1990 [NL] Netherlands ..... 9001530

[51] Int. Cl.[6] ..... G03C 5/00

[52] U.S. Cl. ..... 430/23; 430/26; 430/28; 430/29; 430/291

[58] Field of Search ..... 430/23, 26, 28, 29, 430/291

[56] References Cited

U.S. PATENT DOCUMENTS 4,263,385 4/1981 Panpalone ..... 430/23

4,407,916 10/1983 Akagi et al. ..... 430/23

5,028,501 7/1991 Ritt et al. ..... 430/23

FOREIGN PATENT DOCUMENTS 0192301 8/1986 European Pat. Off. .

*Primary Examiner*—S. Rosasco

*Attorney, Agent, or Firm*—Paul R. Miller

[57] ABSTRACT

At least partly overlapping patterns are formed on a substrate. The substrate is provided with a photosensitive layer which becomes tacky under the influence of light. The layer is exposed according to a pattern. A powder is provided on the exposed portions of the layer. The powder adheres to the exposed portions. Subsequently, the layer is again exposed according to a pattern which at least partly overlaps the first pattern. It has been found that a second powder adheres to the powder which has been provided first. In this manner, several powder layers can be provided on top of each other on one photosensitive layer. This saves time.

18 Claims, 3 Drawing Sheets

METHOD OF FORMING A PATTERN ON A SUBTRATE, METHOD OF MANUFACTURING A DISPLAY DEVICE, DISPLAY DEVICE

The invention relates to a method of forming a pattern on a substrate.

The invention also relates to a method of manufacturing a display device, a pattern being formed on a surface of said display device.

The invention further relates to a display device manufactured according to a method of the type mentioned in the second paragraph.

For certain applications, some of which will be described hereinafter within the framework of the invention, overlapping patterns can be advantageously formed on the substrate. In general, the aim is to restrict the time necessary for providing such patterns as much as possible.

It is an object of the invention to provide, inter alia, a method of the type described in the opening paragraph, which enables overlapping patterns to be rapidly and accurately formed on a substrate.

For this purpose, a method of the type mentioned in the opening paragraph is characterized in that a layer which becomes tacky as a result of exposure is applied to the surface, after which the layer is exposed according to a pattern and a powder is provided on the layer and loose powder particles are removed, after which the layer is exposed according to a next pattern which at least partly overlaps the first pattern, a next powder then being provided on the layer and loose powder particles being removed and the adhering powder particles being fixed on the substrate.

A further object of the invention is to provide, inter alia, a method of the type mentioned in the second paragraph, by means of which overlapping patterns can be rapidly and accurately formed on a surface of the display device.

For this purpose, a method of the type mentioned in the second paragraph is characterized in that a layer which becomes tacky as a result of exposure is applied to said surface, after which the layer is exposed according to a pattern and a powder is provided on the layer and loose powder particles are removed, after which the layer is exposed according to a next pattern which at least partly overlaps the first pattern and a next powder is provided on the layer, loose powder particles being removed and the adhering powder particles being fixed on the substrate.

Photosensitive layers as described above are also termed "phototacky" layers. This is to be understood to mean that the layer becomes tacky under the influence of light (photons). For simplicity, such layers will hereinafter be termed photo-tacky layers.

Within the framework of the invention, "pattern" is to be understood to mean also a uniform layer.

The invention is based, inter alia, on the insight that it is possible to provide two (or more) overlapping patterns on one single photo-tacky layer.

It is assumed that during the second exposure step sufficient material of the photo-tacky layer diffuses through the first-applied powder layer to cause the upper surface of the first-applied powder layer to become tacky, thus causing the next powder layer to adhere to the first powder layer.

As two (or more) powder layers are simultaneously fixed, the method according to the invention is more rapid than a method in which two powder layers are fixed after one another. A further advantage is that, prior to fixing the powder patterns, the mutual position of the powder patterns can be checked.

In an embodiment of the method according to the invention, the surface is a display window and the next powder comprises phosphor particles and the first powder comprises colour-filter particles. This enables a colour-filter layer to be rapidly and accurately provided between the display window and a phosphor layer.

This is important, in particular when the phosphor particles used are low-energy phosphors, i.e. phosphors which luminesce under the influence of electrons having a kinetic energy smaller than approximately 5 KeV.

It is noted, that the use of a "photo-tacky" layer for providing a pattern is known per se, and for providing a pattern on a surface of a display device the use of such a photo-tacky layer is known from European Patent Application No. 192.301. In this Patent Application a description is given of a method in which a photosensitive layer is provided on a display window of a display device, the tackiness of the layer increasing by photolysis when the layer is exposed to ultraviolet light. Subsequently, the layer is exposed to ultraviolet light, with parts of the layer being covered by a mask. Subsequently, a powder layer, for example containing phosphor particles, is provided on the layer. The phosphor particles adhere to the exposed parts of the photosensitive layer. Loose powder particles, i.e. powder particles which do not adhere to the layer, are removed. Next, the powder particles adhering to the layer are fixed on the substrate. In this manner, a single layer is provided on the substrate.

BRIEF DESCRIPTION OF THE DRAWINGS

The invention will be explained in greater detail by means of a few exemplary embodiments and with reference to the accompanying drawing, in which

The Figures are diagrammatic and not drawn to scale, corresponding parts in the various embodiments generally bearing the same reference numerals.

FIG. 1 is a sectional view of a display device, in the present example a cathode ray tube, manufactured according to the method of the invention. In a glass envelope 1, which is composed of a display window 2, a cone 3 and a neck 4, there is provided in the neck 4 an electron gun 8 which generates three electron beams 9, 10 and 11. The display window 2 is provided with a display screen 5 on the inside, which display screen comprises, in this example, a large number of triads of phosphor elements. The elements may consist of lines or dots. Each triad comprises a line having a phosphor luminescing in green, a line having a phosphor luminescing in blue and a line having a phosphor luminescing in red. In this example, the phosphor lines extend transversely to the plane of the drawing. A shadow mask 6 is positioned in front of the display screen, a large number of elongated apertures being formed in the shadow mask through which the electron beams 9, 10 and 11 pass. In operation, the electron beams are deflected across the display screen 5 by a deflection coil system 12.

FIG. 2 is a sectional view of a display window 2 for a display device as shown in FIG. 1. A display screen is provided on the display window 2. Said display screen comprises phosphor elements 20, 21 and 22 which luminesce in red, green and blue, respectively when electrons impinge on them. Colour-filter layers 23, 24 and 25 are present between the phosphor elements 20, 21 and 22 and the display window 2. The color-filter layers filter the light emitted by a phosphor. A blue light-emitting phosphor may also emit, for example, a component of green light. The colour purity of the light emitted by the display device is improved by means of a colour-filter layer which is transparent to blue light but absorbs red and green light. The colour-filter layer is arranged between the phosphor layer and the display window. This has the advantage, relative to a situation in which colour-filter particles are present among the phosphor particles, that a larger number of electrons impinge on the phosphor particles. This leads to an improved brightness and contrast of the image. This is important, in particular, when in operation the phosphor particles are excited by electrons having a low kinetic energy, i.e. lower than 5 KeV. This is the case, inter alia, in certain types of flat cathode ray tubes.

Figure 1:
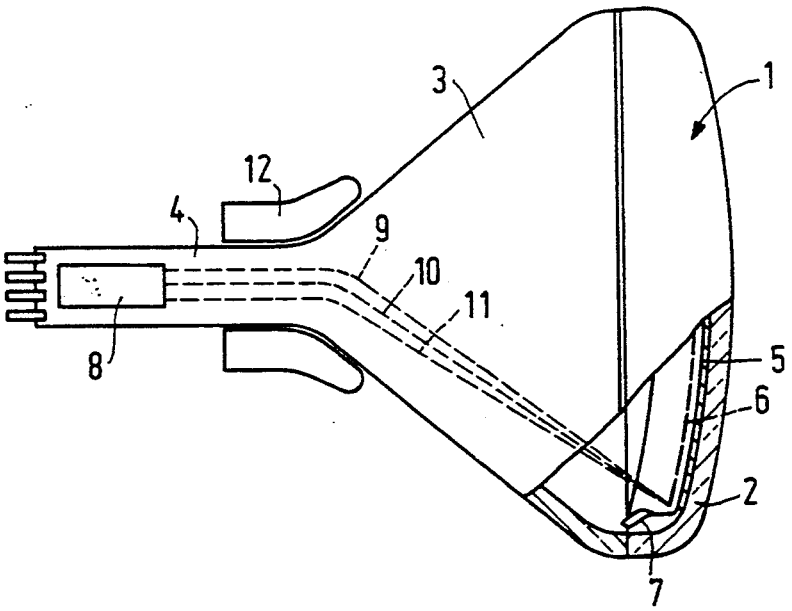
FIG. 1 is a sectional view of a display device manufactured according to the method of the invention.
Figure 2:
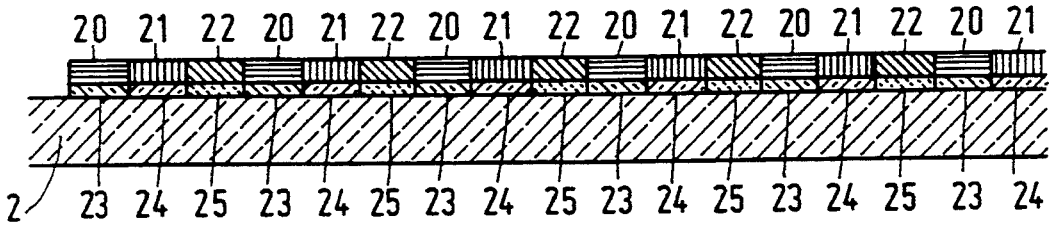
FIG. 2 is a sectional view of a display window for a display device as shown in FIG. 1.
Figure 3:
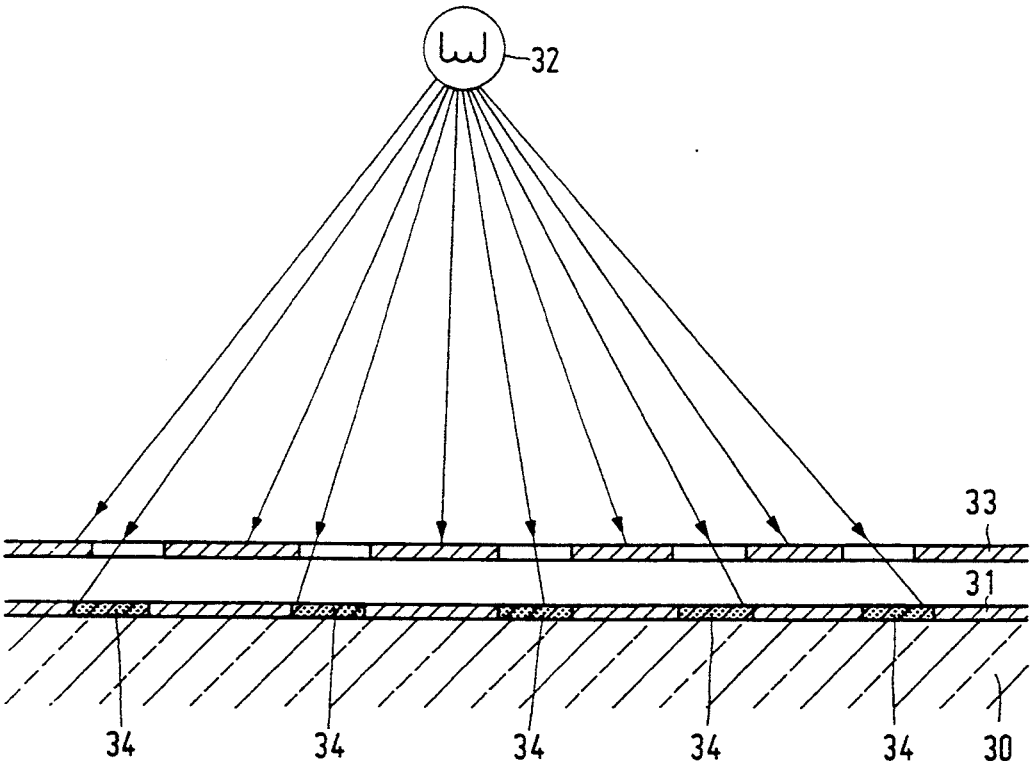
FIGS. 3, 4, 5, 6, 7 and 8 are illustrations of the method according to the invention.
Figure 4:
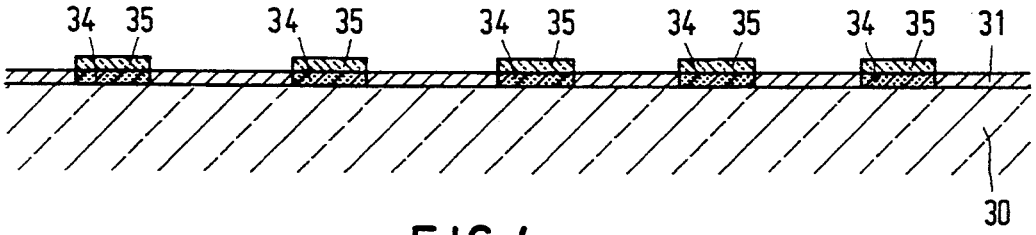

A photo-tacky layer 31 is applied to a substrate 30, for example a display window of a display device, the tackiness of the layer increasing when the layer is exposed. Examples of such layers are described in European Patent Application 192,301. The photo-tacky layer is exposed to ultraviolet light emitted by an ultraviolet source 32. A mask 33 is arranged between the source 32 and the photo-tacky layer 31. The exposed portions 34 of the photo-tacky layer 31 become tacky (FIG. 3). In an example, the portions 34 are exposed using a dose of approximately 5 to 25 millJoule/cm$^2$. The thickness of the photo-tacky layer is approximately a few $\mu$m. Subsequently, a powder layer is provided which comprises, for example, colour-filter powder particles. The thickness of the powder layer is, for example, a few tenths of a $\mu$m to a few $\mu$m. The colour-filter powder particles adhere to the exposed portions 34 of the photo-tacky layer 31. Loose colour-filter particles are subsequently removed. The exposed portions 34 are then covered with a pattern 35 of colour-filter particles (FIG. 4).

Figure 5:
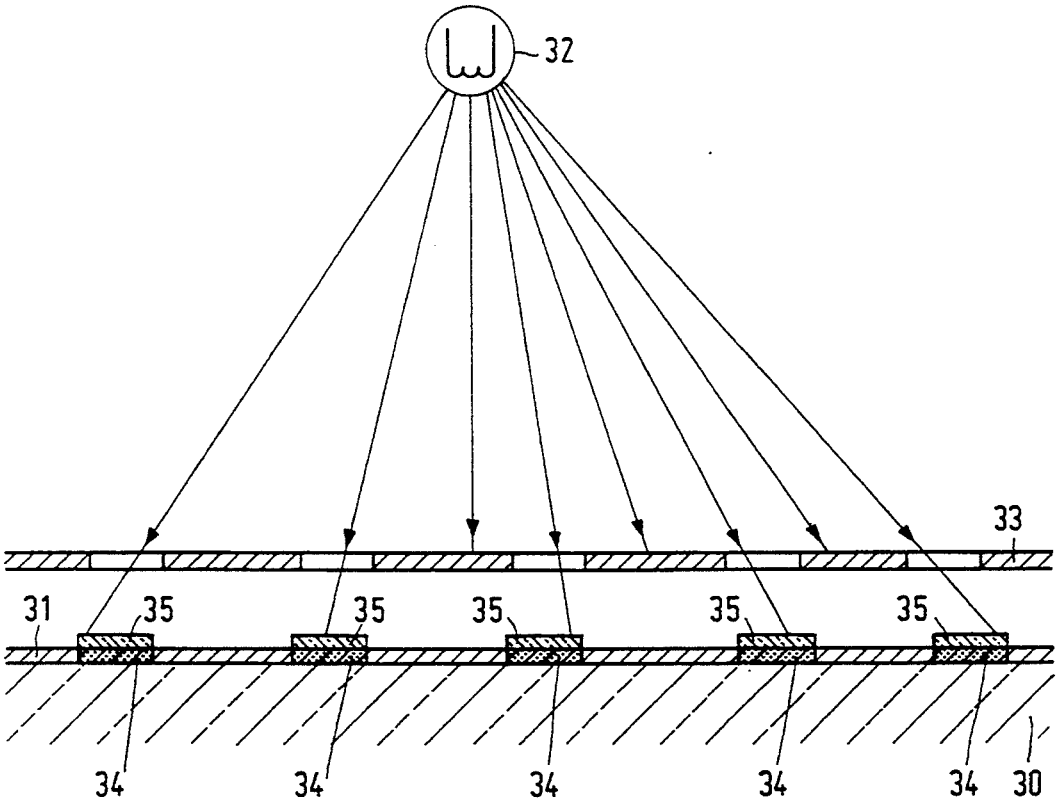

Subsequently, the photo-tacky layer 31, provided with pattern 35, is again exposed, such that at least partly the already exposed portions 34 are exposed again (FIG. 5). In this second exposure step, the portions 34 are preferably more strongly exposed than in the first, above-mentioned exposure step, for example using a dose of approximately 100 to approximately 300 milliJoule/cm$^2$. It has been found that a next powder provided after the second exposure adheres to the pattern 35. The next powder layer has a thickness of, for example, a few $\mu$m.

FIGS. 3 and 5 show an arrangement in which the surface of the substrate 30 which is covered with the photo-tacky layer 31 faces the light source. This is not to be interpreted in a restrictive manner. In one or both exposure steps, the photo-tacky layer 31 can be exposed through the substrate 30.

Figure 6:
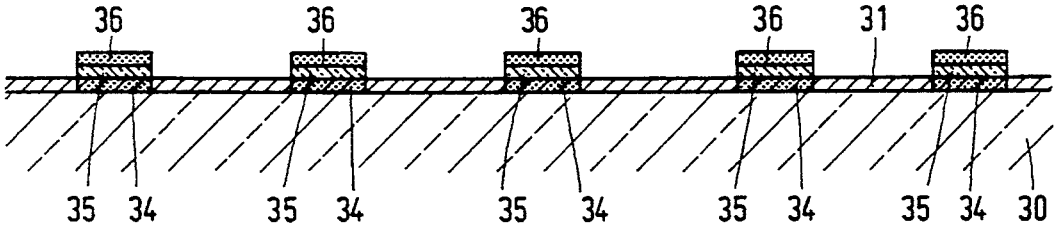
Figure 7:
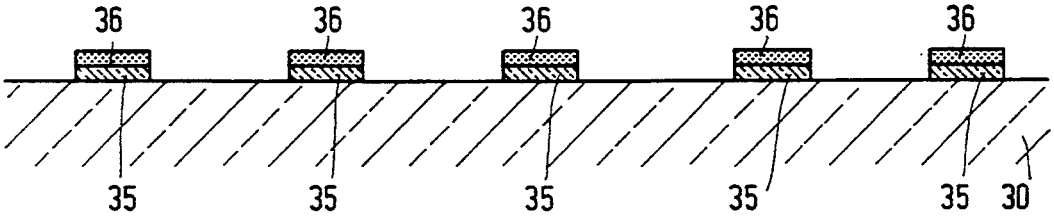

It is assumed that during the second exposure step sufficient material of the photo-tacky layer or a sufficient quantity of a constituent of the photo-tacky layer diffuses through the powder layer of the pattern 35 to render the upper surface of the pattern 35 so tacky that the next powder adheres to the pattern 35. In this example, the next powder comprises phosphor particles. Loose phosphor particles are subsequently removed. Portions 34 of the photo-tacky layer 31 are now covered with a pattern 35 of colour-filter particles on which a pattern 36 of phosphor particles is situated (FIG. 6). Both layers are then fixed on the substrate 30 (FIG. 7) in one process step, for example in a manner as described for a single layer in EP 192,301.

It will be obvious that the invention is not limited to the example described herein. For example, in a first step a red colour-filter pattern may be provided to which a red phosphor pattern is applied, after which a blue colour-filter pattern is provided next to the red colour-filter pattern, on which blue colour-filter pattern a blue phosphor pattern is provided, after which a green colour-filter pattern is provided next to the red and blue colour-filter patterns, to which green colour-filter pattern a green phosphor pattern is applied, all colourfilter patterns and phosphor patterns then being fixed in one process step. It is alternatively possible to provide three adjacent colour-filter patterns to which a uniform, white light emitting phosphor layer is applied. The first powder layer is not limited to a colour-filter layer. The first powder layer may be a phosphor layer. It is possible, for example, to stack phosphor layers of various colours or compositions, for example having different grain sizes. The first layer may be a colour-filter layer and the second layer may consist of glass particles. The powder particles can be fixed by heating the display window to a temperature above the flow temperature of the glass particles. A glass layer is then formed in which the colour-filter particles are fixed. Subsequently, a phosphor pattern (for example for a cathode my tube - display device) or an electrode pattern (for example for a LCD (Liquid Crystal Display) - device) can be provided on the glass layer. The surface of the display device may alternatively be, for example, a shadow mask on which a double layer is provided, for example a glass layer to which an index-phosphor pattern is applied. Within the scope of the invention, many variations are possible to those skilled in the art.

Figure 8:
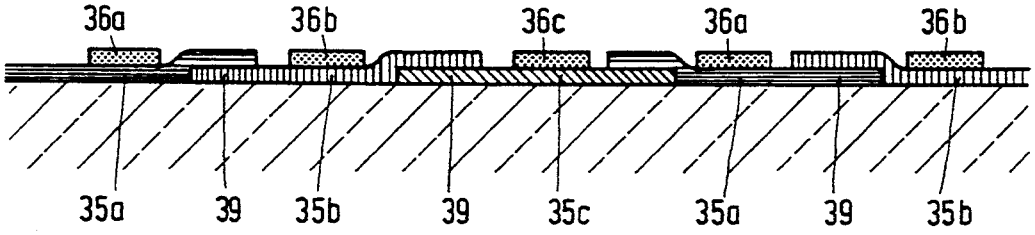

FIG. 8 shows, for example, an embodiment in which colour-filter patterns 35*a*, 35*b* and 35*c* are provided on the display window 30. Colour-filter pattern 35*a* passes blue light and absorbs red and green light, colour-filter pattern 35*b* passes red light and absorbs blue and green light, colour-filter pattern 35*c* passes green light and absorbs red and blue light. Phosphor patterns 36*a* (comprising a phosphor luminescing in blue), 36*b* (red phosphor) and 36*c* (green phosphor) are provided on the colour-filter patterns. The colour-filter patterns overlap each other at locations 39. As a result thereof, a so-called matrix effect is obtained; a strip is provided between the phosphors (at locations 39) which absorbs all the light. In this manner, the separate provision of a matrix pattern is superfluous.

Thus, FIG. 8 shows a display window of a display device, which is provided on one side with at least two colour-later patterns, the colour-filter patterns overlapping each other in such a manner mat the overlaps of the colour-filter patterns form a matrix pattern. It is noted that overlapping colour-filter patterns can also be provided on the display window in a different manner, for example by vacuum evaporation. The method according to the invention enables overlapping colour-filter patterns to be rapidly and accurately provided.

I claim:

1. A method of providing material on a substrate to form a pattern on the substrate comprising the steps of (a) applying to said substrate a layer which becomes tacky upon exposure to radiation, (b) exposing said layer to said radiation through a first mask to form a first pattern of tacky portions, (c) providing first powder particles on said tacky portions of said layer and removing loose first powder particles, (d) exposing said layer to said radiation through a second mask to form at least one second pattern, said second pattern at least partly overlapping said first pattern, wherein said second pattern including the at least partly overlapping portions becomes tacky, (e) providing at least second powder particles on said second pattern and removing loose second powder particles, and (f) simultaneously fixing adhered first and second powder particles to said substrate.

2. A method according to claim 1, wherein said second powder particles are stacked upon and adhere to said first powder particles at areas of overlap of said first and second patterns.

3. A method according to claim 1, wherein said step (b) is carried out at a first dose of said radiation, and said step (d) is carried out at a second much higher dose of said radiation.

4. A method according to claim 3, wherein said first dose of radiation ranges between 5 and 25 milliJoule/cm$^2$, and said second dose of radiation ranges between 100 to 300 milliJoule/cm$^2$.

5. A method according to claim 1, wherein said layer in step (a) is a photosensitive layer.

6. A method according to claim 1, wherein said radiation is ultraviolet light.

7. A method of manufacturing a display window for a display device comprising the steps of forming a pattern on a surface of the display window by the steps of (a) applying to the surface a layer which becomes tacky upon exposure to radiation, (b) exposing said layer to said radiation through a first mask to form a first pattern of tacky portions, (c) providing first powder particles on said tacky portions of said layer and removing loose first powder particles, (d) exposing said layer to said radiation through a second mask to form at least one second pattern, said second pattern at least partly overlapping said first pattern, wherein said second pattern including the at least partly overlapping portions becomes tacky, (e) providing at least second powder particles on said second pattern and removing loose second powder particles, and (f) simultaneously fixing adhered first and second powder particles to said surface.

8. A method as claimed in claim 7, wherein said second powder particles contain phosphor particles, and said first powder particles comprise color-filter particles.

9. A method as claimed in claim 8, wherein said phosphor particles comprise low-energy phosphors.

10. A method as claimed in claim 7, wherein said second powder particles comprise glass particles, and said first powder particles comprise color-filter particles.

11. A method according to claim 7, wherein said first powder particles comprise color-filter particles of a first color, and said second powder particles comprise color-filter particles of a second different color.

12. A method according to claim 7, wherein said second powder particles are stacked upon and adhere to said first powder particles at areas of overlap of said first and second patterns.

13. A method according to claim 7, wherein said step (b) is carried out at a first dose of said radiation, and said step (d) is carried out at a second much higher dose of said radiation.

14. A method according to claim 13, wherein said first dose of radiation ranges between 5 and 25 milliJoule/cm$^2$, and said second dose of radiation ranges between 100 to 300 milliJoule/cm$^2$.

15. A method according to claim 7, wherein said layer in step (a) is a photosensitive layer.

16. A method according to claim 7, wherein said radiation is ultraviolet light.

17. A display window comprising a display screen, a photo-tacky layer on an inner surface of said display screen, a first pattern of first powder particles fixed to said layer, and at least one second pattern of at least second powder particles fixed in at least partly overlapping relation to said first pattern, wherein said second powder particles are stacked upon and adhere to said first powder particles at areas of overlap of said first and second patterns.

18. A display window according to claim 17, wherein said first powder particles are color-filter particles, and said second powder particles are phosphor particles.

* * * * *